US010533388B2

(12) United States Patent
Wesson et al.

(10) Patent No.: US 10,533,388 B2
(45) Date of Patent: Jan. 14, 2020

(54) FLOW DIVERTER

(71) Applicant: Access Downhole LP, Norman, OK (US)

(72) Inventors: Shea Keller Wesson, Norman, OK (US); Harold Robinson Wesson, Jr., Norman, OK (US)

( * ) Notice: Subject to any disclaimer, the term of this patent is extended or adjusted under 35 U.S.C. 154(b) by 54 days.

(21) Appl. No.: 15/608,404

(22) Filed: May 30, 2017

(65) Prior Publication Data

US 2017/0342788 A1 Nov. 30, 2017

Related U.S. Application Data

(60) Provisional application No. 62/343,371, filed on May 31, 2016.

(51) Int. Cl.

| | |
|---|---|
| ***E21B 21/08*** | (2006.01) |
| ***E21B 4/02*** | (2006.01) |
| ***E21B 21/10*** | (2006.01) |
| *E21B 21/00* | (2006.01) |

(52) U.S. Cl.

CPC ..... *E21B 21/08* (2013.01); *E21B 4/02* (2013.01); *E21B 21/10* (2013.01); *E21B 21/103* (2013.01); *E21B 2021/006* (2013.01)

(58) Field of Classification Search

CPC . E21B 21/08; E21B 4/02; E21B 21/10; E21B 21/103; E21B 2021/006

See application file for complete search history.

(56) References Cited

U.S. PATENT DOCUMENTS

| | | | | |
|---|---|---|---|---|
| 3,989,114 | A | 11/1976 | Tschirky et al. | |
| 4,298,077 | A | 11/1981 | Emery | |
| 5,890,540 | A | 4/1999 | Pia et al. | |
| 6,095,249 | A * | 8/2000 | McGarian | E21B 21/002 166/319 |
| 6,263,969 | B1 | 7/2001 | Stoesz et al. | |
| 6,675,897 | B1 * | 1/2004 | McGarian | E21B 21/103 166/151 |
| 7,357,198 | B2 * | 4/2008 | Mcgarian | E21B 21/103 166/319 |
| 8,960,334 | B1 | 2/2015 | Branton | |
| 9,228,402 | B2 | 1/2016 | Strilchuk | |
| 9,267,345 | B2 * | 2/2016 | Grande | E21B 23/006 |
| 2013/0319767 | A1 * | 12/2013 | Wilson | E21B 21/10 175/24 |

* cited by examiner

*Primary Examiner* — Yong-Suk Ro

(74) *Attorney, Agent, or Firm* — Bruce LaBrie; Resolution Legal Group

(57) ABSTRACT

A flow diverter is provided having a first sub member, a second sub member, a third sub member connected in series and a piston, a spring, and a sleeve member. The sleeve member is removeably disposed within the second sub member. The spring concentrically surrounds at least a portion of the piston and the spring are slidably disposed within the first sub member with the piston further slidably disposed within the second sub member and at least a portion of the third sub member. A drilling fluid having a first predetermined pressure passes through the flow diverter. The drilling fluid having a second predetermined pressure moves the piston until at least a portion of the drilling fluid passes through bypass ports formed in the piston, sleeve member, and second sub member and out of the flow diverter, thus controlling the pressure of the drilling fluid.

15 Claims, 5 Drawing Sheets

FLOW DIVERTER

CROSS-REFERENCE TO RELATED APPLICATION

This application claims priority to U.S. Provisional Application Ser. No. 62/343,371, filed on May 31, 2016, the entire contents of which being hereby expressly incorporated herein by reference.

BACKGROUND

In many applications, an oil or gas well is drilled with a fluid driven motor, also referred to as a mud motor. The mud motor is affixed to the lower end of a drill pipe or drill string. Drilling fluid, or mud, is pumped down through the drill pipe that forms the drill string by pumps situated at the surface of a drill site. The drilling fluid is pumped downhole through the drill pipe under pressure and passes through the mud motor, turning a rotor within the mud motor. For a given mud motor, there is an optimum, a minimum, and a maximum mud flow rate. The rotor turns a drive shaft that turns a drill bit to drill through the downhole formations. Similarly, a milling tool can be affixed to the mud motor instead of a drill bit for milling metal items that may be found downhole. After passing through the mud motor, the drilling fluid typically passes on through the drill bit or milling tool. After exiting the drill bit or milling tool, the drilling fluid passes back up the well bore in an annular space around the drill string.

As the drill bit turns and drills through the formation, it grinds, tears, or gouges pieces of the formation loose. These pieces of the formation, called cuttings, can vary in size from powdery particles to large chunks, depending upon the type of formation, the type of drill bit, the weight on the drill bit, and the speed of rotation of the drill bit. Similarly, as a milling tool turns, it removes cuttings from the metal item being milled away or milled through. As the drilling fluid exits the drill bit or milling tool, it entrains the cuttings and carries them up the annulus of the well bore to the surface of the well site. At the surface, the cuttings are removed from the drilling fluid, which may then be recycled downhole.

Depending upon the type of formation, the drilling depth, and many other factors, the drilling fluid used at any given time is designed to satisfy various requirements relative to the well drilling operation. One of the functions of the drilling fluid is to keep the cuttings in suspension and to carry them to the surface of the well site for disposal. If the cuttings are not efficiently removed from the well bore, the drill bit or milling tool can become clogged, limiting its effectiveness. Similarly, the well bore annulus can become clogged, preventing further circulation of drilling fluid, or even causing the drill pipe to become stuck. Therefore, the cuttings must flow with the drilling fluid up the annulus to the surface. Various features of the drilling fluid are chosen so that removal of the cuttings will be insured. The two main features selected to insure cutting removal are drilling fluid viscosity and flow rate.

Adequate viscosity can be insured by proper formulation of the drilling fluid. Adequate flow rate is insured by operating the pumps at a sufficiently high speed to circulate drilling fluid through the well at the required volumetric velocity and linear velocity to maintain cuttings in suspension. In some circumstances, the mud flow rate required for cutting removal is higher than the maximum desired mud flow rate through the mud motor. This can be especially true when the mud motor moves into an enlarged bore hole, where the annulus is significantly enlarged. If the maximum desired flow rate for the mud motor is exceeded, the mud motor can be damaged. On the other hand, if the mud flow rate falls below the minimum flow rate for the mud motor, drilling is inefficient, and the motor may stall.

In cases where keeping the cuttings in suspension in the bore hole annulus requires a mud flow rate greater than the maximum allowed mud flow rate through the motor, there may be a means for diverting some of the mud flow from the bore of the drill string to the annulus, generally at a point near, but just above, the mud motor. This will prevent exceeding the maximum mud flow rate for the mud motor, while providing an adequate flow rate in the annulus to keep the cuttings in suspension.

Some tools are known for this and similar purposes. Some of the known tools require the pumping of a ball downhole to block a passage in the mud flow path, usually resulting in the shifting of some flow control device downhole to divert drilling fluid to the annulus. Such tools usually suffer from the disadvantage of not being returnable to full flow through the mud motor in the event that reduced mud flow becomes possible thereafter. Other such tools might employ a fracture disk or other release means with these release means suffering from the same disadvantage of not being reversible. At least one known tool uses mud pump cycling to move a sleeve up and down through a continuous J-slot to reach a portion of the J-slot, which will allow increased longitudinal movement of the sleeve, ultimately resulting in the opening of a bypass outlet to the annulus. This tool suffers from the disadvantage that the operator must have a way of knowing exactly the position of the J-slot pin to initiate bypass flow at the appropriate time. Initiating increased flow when bypass has not been established can damage the mud motor; while operating at low flow when bypass has been established will lead to poor performance or stalling.

Therefore, a need exists for a tool that will reliably bypass a portion of the drilling fluid to the annulus when a predetermined flow rate is exceeded and that will close the bypass path when the flow rate falls back below a predetermined level. This will allow the operator to have complete control of the bypass flow by operation of the drilling fluid pumps at selected levels. It is to such a tool that the inventive concepts disclosed herein are directed.

DETAILED DESCRIPTION OF EXEMPLARY EMBODIMENTS

Figure 1:
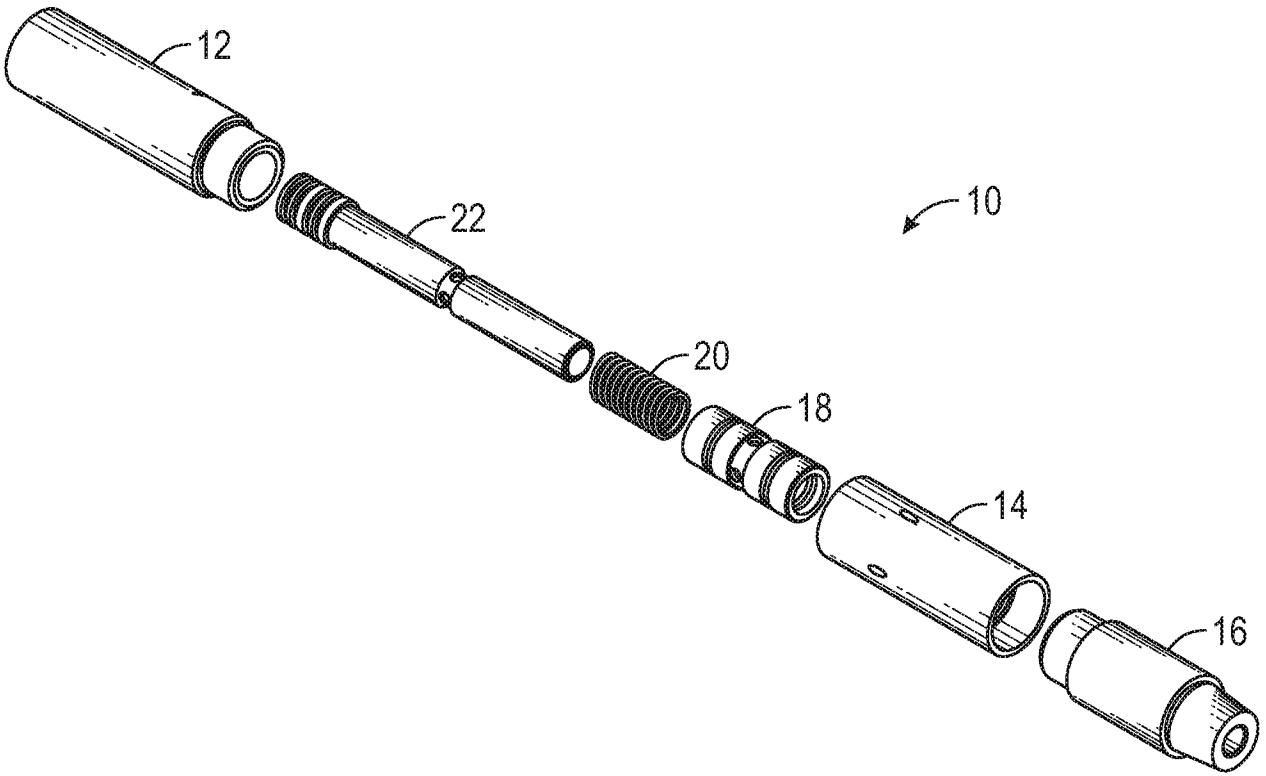
FIG. 1 is an exploded, perspective view of an exemplary flow diverter in accordance with the presently disclosed inventive concepts.

Before explaining at least one embodiment of the disclosure in detail, it is to be understood that the disclosure is not limited in its application to the details of construction, experiments, exemplary data, and/or the arrangement of the components set forth in the following description or illustrated in the drawings unless otherwise noted.

The systems and methods as described in the present disclosure are capable of other embodiments or of being practiced or carried out in various ways. Also, it is to be understood that the phraseology and terminology employed herein is for purposes of description, and should not be regarded as limiting.

The following detailed description refers to the accompanying drawings. The same reference numbers in different drawings may identify the same or similar elements.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements, but may also include other elements not expressly listed or inherent to such process, method, article, or apparatus.

Further, unless expressly stated to the contrary, "or" refers to an inclusive and not to an exclusive "or". For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more, and the singular also includes the plural unless it is obvious that it is meant otherwise. Further, use of the term "plurality" is meant to convey "more than one" unless expressly stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

As used herein, the term "drilling fluid" or "drill fluid" refers to circulating fluid used in rotational drilling to perform various functions during drilling operations.

Referring now to the drawings, and in particular to FIG. 1, shown therein is an embodiment of a flow diverter 10 constructed in accordance with the inventive concepts disclosed herein. The flow diverter 10 can be a part of a drill stem and/or bottom hole assembly and used as part of a drill string to drill a well into a subterranean formation. In general, the flow diverter 10 has a housing 11 (FIGS. 7 and 8), which in one embodiment includes a first sub member 12, a second sub member 14, a third sub member 16, and a sleeve member 18. The flow diverter 10 further includes at least one spring 20 and a piston 22. A first end 30 of the first sub member 12 is adapted to be affixed to a lower end of a drill string (not shown), such as, for instance, by threaded connection. A second end 78 of the third sub member 16 is adapted to be affixed to an upper end of a mud motor housing (not shown), or in some embodiments to a drill pipe (also not shown) such as, for instance, by threaded connection.

Figure 2:
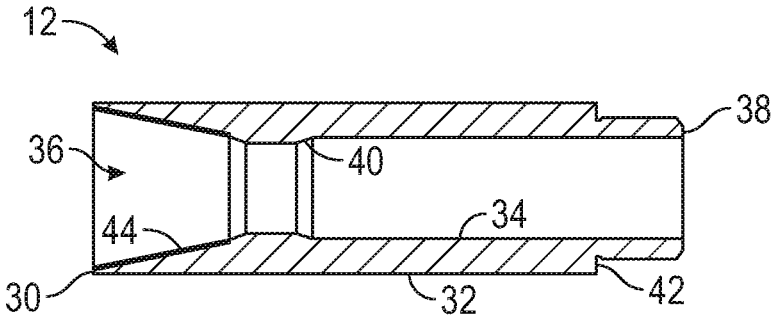
FIG. 2 is a sectional view of a first sub member of the flow diverter of FIG. 1.

Referring now to FIG. 2, in one embodiment of the flow diverter 10, the first sub member 12 is provided with the first end 30, an outer surface 32, and an inner surface 34 which forms a first bore 36 extending from the first end 30 to a second end 38. A first shoulder 40 is formed on the inner surface 34 of the first sub member 12 and defines a portion of the first bore 36 having a predetermined diameter and extending a predetermined distance from the second end 38. A second shoulder 42 is formed on the outer surface 32 of the first sub member 12. The second shoulder 42 has a predetermined depth extending inward from the outer surface 32 and a predetermined distance from the second end 38 of the first sub member 12.

As shown in FIG. 2, the first sub member 12 may be provided having a connecting portion 44 which may be, for instance, a threaded connector configured to threadably connect the first sub member 12 to an end of a drill string member (not shown) to form a tool joint (also not shown) as is known in the art.

Figure 3:
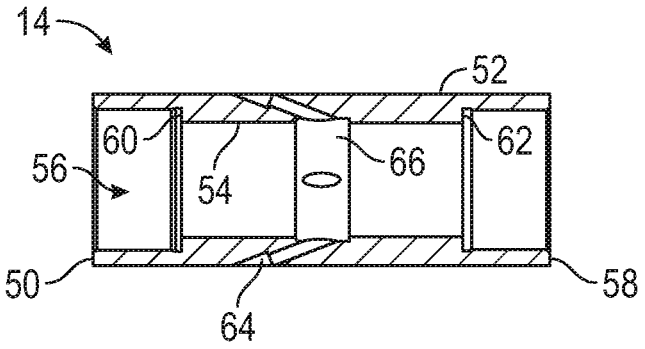
FIG. 3 is a sectional view of a second sub member of the flow diverter of FIG. 1.

Referring now to FIG. 3, in one embodiment of the flow diverter 10, the second sub member 14 is provided with a first end 50, an outer surface 52, and an inner surface 54 which forms a second bore 56 extending from the first end 50 to a second end 58. A first shoulder 60 is formed extending a predetermined distance from the inner surface 54 and a predetermined distance from the first end 50. A second shoulder 62 is formed extending a predetermined distance from the inner surface 54 and a predetermined distance from the second end 58. A plurality of bypass ports 64 extend from the outer surface 52 to a bypass groove 66 formed in the inner surface 54.

Figure 4:
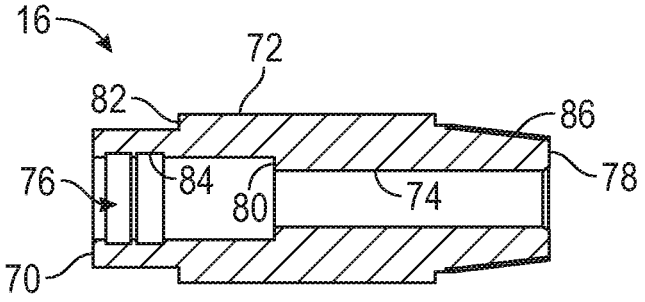
FIG. 4 is a sectional view of a third sub member of the flow diverter of FIG. 1.

Referring now to FIG. 4, in one embodiment of the flow diverter 10, the third sub member 16 is provided with a first end 70, an outer surface 72, and an inner surface 74 which forms a third bore 76 extending from the first end 70 to a second end 78. A first shoulder 80 is formed in the bore 76 of the third sub member 16 extending substantially perpendicularly a predetermined distance from the inner surface 74 and a predetermined distance from the first end 70. A second shoulder 82 is formed on the outer surface 72 of the third sub member 16 extending substantially perpendicularly a predetermined distance from the outer surface 72 and a predetermined distance from the first end 70.

As shown in FIG. 4, in some embodiments of the flow diverter 10, the third sub member 16 may be provided with at least one seal groove 84 (only one of which is designated in FIG. 4) formed on the inner surface 74. The at least one seal groove 84 may be appropriately sized to hold a seal (not shown) as is known in the art.

In some embodiments of the flow diverter 10, the third sub member 16 may further be provided with a connecting portion 86 formed on the outer surface 72 of the third sub member 16. The connecting portion 86 may be, for instance, a threaded connector configured to threadably connect the third sub member 16 to an end of a fluid driven motor (not shown) as is known in the art.

Figure 5:
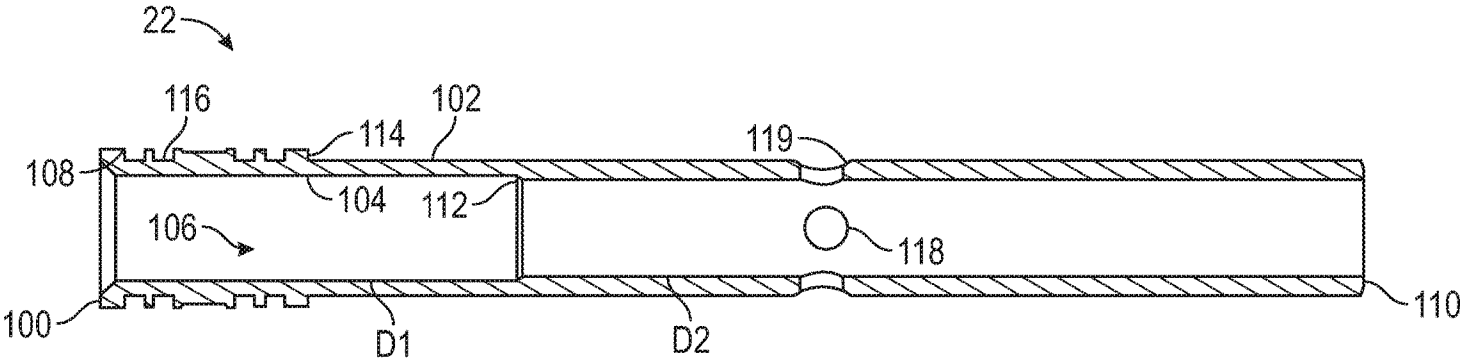
FIG. 5 is a sectional view of a piston of the flow diverter of FIG. 1.

Referring now to FIG. 5, in one embodiment of the flow diverter 10, the piston 22 is provided with a first end 100, an outer surface 102, and an inner surface 104 forming a piston bore 106 extending from a first orifice 108 formed in the first end 100 to a second end 110. The piston 22 may further be provided with a second orifice 112, a shoulder 114, at least one seal groove 116 (only one of which is designated in FIG. 5), and a plurality of bypass ports 118 extending from the inner surface 104 through a bypass groove 119 formed in the outer surface 104 of the piston 22.

In the embodiment shown in FIG. 5, the second orifice 112 is formed in the piston bore 106 a predetermined distance from the first end 100 and extending a predetermined distance from the inner surface 104. In such an embodiment, the piston bore 106 of the piston 22 has a first diameter D1 extending from the first orifice 108 to the second orifice 112, and a second diameter D2, which is smaller than the first diameter D1, extending from the second orifice 112 to the second end 110 of the piston 22.

The shoulder 114 of the piston 22 is formed on the outer surface 102 and extends substantially perpendicularly a predetermined distance from the outer surface 102 and a predetermined distance from the second end 110.

As shown in FIG. 5, the seal grooves 116 may be formed in the outer surface 102 of the piston 22. The seal grooves 116 may be sized appropriately to accept seals (not shown) as is known in the art.

Figure 6:
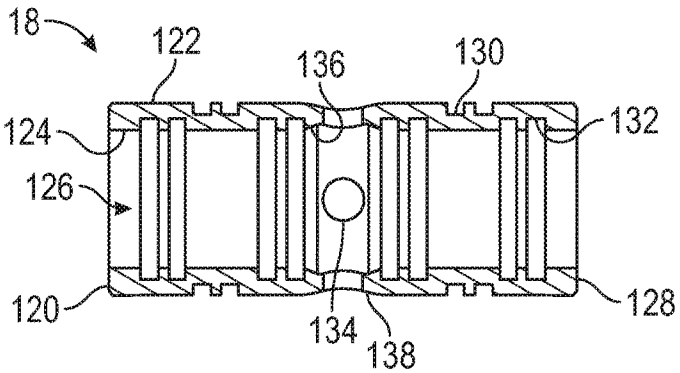
FIG. 6 is a sectional view of a sleeve member of the flow diverter of FIG. 1.

Referring now to FIG. 6, shown therein is one embodiment of the sleeve member 18 of the flow diverter 10. In the embodiment shown, the sleeve member 18 is provided with a first end 120, an outer surface 122, and an inner surface 124 which defines a sleeve member bore 126 extending from the first end 120 to a second end 128. As shown in FIG. 6, the sleeve member 18 may further be provided having at least one outer seal groove 130 (only one of which is designated in FIG. 6), at least one inner seal groove 132 (only one of which is designated in FIG. 6), and a plurality of bypass ports 134 (only one of which is designated in FIG. 6) extending from an inner bypass groove 136 formed on the inner surface 124 through an outer bypass groove 138 formed on the outer surface 122 of the sleeve member 18.

Figure 7:
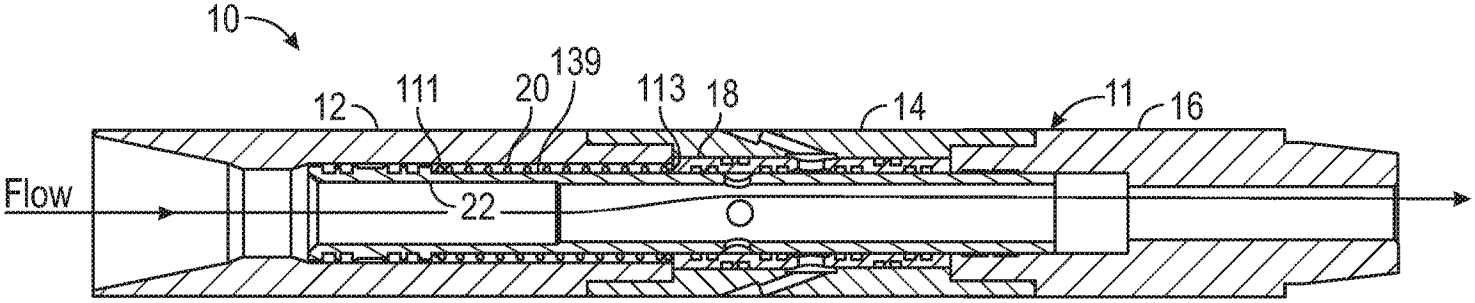
FIG. 7 is a longitudinal section view showing the flow diverter of FIG. 1 assembled and in a non-diverted configuration in accordance with one embodiment of the presently disclosed inventive concepts.
Figure 8:
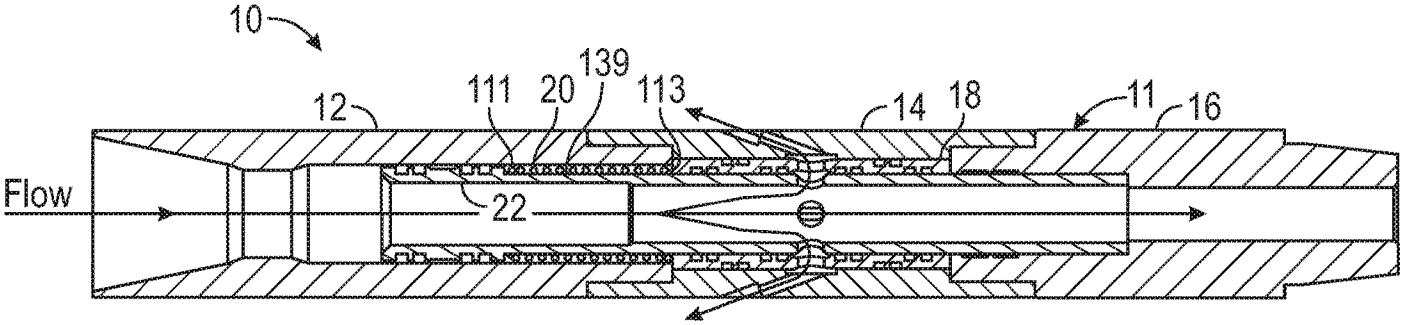
FIG. 8 is a longitudinal section view showing the flow diverter of FIG. 1 assembled and in a full diverted configuration in accordance with one embodiment of the presently disclosed inventive concepts.

Referring now to FIGS. 7 and 8, shown therein is the flow diverter 10 assembled in accordance with one embodiment of the present disclosure. As shown in FIGS. 7 and 8, the first sub member 12 is connected to the second sub member 14 which in turn is connected to the third sub member 16.

In such an embodiment, the outer surface 32 of the first sub member 12 at least partially interfaces with the inner surface 54 of the second sub member 14. To facilitate a fluid tight seal, seal members (not shown) may be provided which at least partially interface with the outer surface 32 of the first sub member 12 and the inner surface 54 of the second sub member 14. Similarly, the outer surface 72 of the third sub member 16 at least partially interfaces with the inner surface 54 of the second sub member 14. To facilitate a fluid tight seal, seal members (not shown) may be provided which at least partially interface with the outer surface 72 of the third sub member 16 and the inner surface 54 of the second sub member 14.

In the embodiments shown in FIGS. 7 and 8, the sleeve member 18 is removeably secured within the second sub member 14. In such an embodiment, at least a portion of the outer surface 122 of the sleeve member 18 is concentrically surrounded by and in fluid contact with at least a portion of the inner surface 54 of the second sub member 14. To facilitate a fluid tight seal between the outer surface 122 of the sleeve member 18 and the inner surface 54 of the second sub member 14, seal members (not shown) may be disposed in the outer seal grooves 130 of the sleeve member 18 at least partially interfacing with the inner surface 54 of the second sub member 14.

To facilitate a secure connection, the sleeve member 18 may be dimensioned such that when the sleeve member 18 is disposed within the second sub member 14, the second end 38 of the first sub assembly at least partially interfaces with the first end 120 of the sleeve member 18 and the first end 70 of the third sub member 16 at least partially interfaces with the second end 128 of the sleeve member 18 when the flow diverter 10 is assembled as shown in FIGS. 7 and 8.

As shown in FIGS. 7 and 8, the spring 20 is positioned in a spring receiving chamber 139 defined by the outer surface 102 of the piston 22 and the inner surface 34 of the first sub member 12 such that the spring 20 concentrically surrounds at least a portion of the outer surface 102 of the piston 22. The piston 22 is slidably disposed for reciprocal longitudinal movement within the first bore 36 of the first sub member 12 with at least a portion of the piston 22 further slidably disposed within the sleeve member bore 126 of the sleeve member 18, and the third bore 76 of the third sub member 16.

In this embodiment, the first bore 36 of the first sub member 12 serves to act as a linear guide for the piston 22 and the spring 20, and the sleeve member bore 126 of the sleeve member 18 and the third bore 76 of the third sub member 16 serve to act as further linear guides for the piston 22.

To facilitate a fluid tight connection between the piston 22 and the first sub member 12, the sleeve member 18, and the third sub member 16, seal members (not shown) may be disposed in the seal grooves 116 of the piston 22 as well as inner seal grooves 132 of the sleeve member 18, and the grooves 84 of the third sub member 16. The seal members disposed in the seal grooves 116 of the piston 22 at least partially interface with the inner surface 34 of the first sub member 12 and the seal members disposed in the inner seal grooves 132 of the sleeve member 18, and the grooves 84 of the third sub member 16 at least partially interface with the outer surface 102 of the piston 22. Because of the fluid tight seal between the piston 22 and the first sub member 12, the sleeve member 18, and the third sub member 16, the spring 20 is fluidically sealed from the piston bore 106 and thus from the drilling fluid passing through the flow diverter 10.

As shown in FIGS. 7 and 8, when the piston 22 and the spring 20 are disposed within the housing 11, at least a portion of a first end 111 of the spring 20 is in contact with the shoulder 114 of the piston 22 which acts as a stop for the first end 111 of the spring 20. The first end 120 of the sleeve member 18 is in contact with at least a portion of a second end 113 of the spring 20 which acts as a stop for the second end 113 of the spring 20.

The spring 20 has a predetermined spring rate and biases the piston 22 into contact with the first shoulder 40 of the first sub member 12, which acts as an upper stop or an upper limit for the piston 22. When the piston 22 is in this upward position, the flow diverter 10 is in a non-diverted position, as shown in FIG. 7. In the non-diverted position, substantially all the drilling fluid is directed to pass longitudinally through the flow diverter 10.

Downward movement of the piston 22 compresses the spring 20 between the first and second stops. This downward movement of the piston 22 is limited by the first shoulder 80 of the third sub member 16, which acts as a stop when the second end 110 of the piston 22 contacts the first shoulder 80 of the third sub member 16. When the piston 22 is in this downward position, the flow diverter 10 is in a full diverted position, as shown in FIG. 8. In the full diverted position, the bypass ports 64, 118, and 134 of the second sub member 14, the piston 22, and the sleeve member 18, respectively, are substantially aligned longitudinally allowing at least a portion of the drilling fluid to be diverted outside the flow diverter 10.

In operation, drilling fluid under pressure is directed through a drill string (not shown) and enters the flow diverter 10 through the first bore 36 of the first sub member 12. Substantially all the drilling fluid having a first predetermined pressure will be allowed to pass longitudinally through the flow diverter 10 and to a downhole tool (not shown) such as, for instance, a fluid driven motor.

As the drilling fluid pressure increases, the piston 22 is forced downward and begins to compress the spring 20. Drilling fluid having a second predetermined pressure, which is higher than the first predetermined pressure, exerts sufficient force on the piston 22 to move the piston 22 downward until the bypass ports 64, 118, and 134 of the second sub member 14, the piston 22, and the sleeve member 18, respectively, are substantially aligned longitudinally allowing at least a portion of the drilling fluid, and therefore the pressure, to be diverted outside the flow diverter 10.

As the fluid pressure decreases, for example, because the drilling fluid is pumped at a lower rate or because fluid pressure has been diverted through the flow diverter 10, the spring 20 forces the piston 22 upward to the non-diverted position and substantially all the drilling fluid again passes longitudinally through the flow diverter 10.

As discussed herein, the first predetermined pressure and the second predetermined pressure refer to the pressure of drilling fluid before the drilling fluid passes through the flow diverter 10. As will be recognized by a person of skill in the art, the first orifice 108, the second orifice 112, the first diameter D1, and the second diameter D2 of the piston 22 act as restrictions to the flow of the drilling fluid which will cause further differences in the drilling fluid pressure as the drilling fluid passes through the piston 22. The effects of the first orifice 108, the second orifice 112, the first diameter D1, and the second diameter D2 on the drilling fluid pressure as it passes through the piston 22 (i.e., creation of a pressure differential between the first end 100 and the second end 110) are known in the art and therefore have not been described in detail herein. However, for the sake of clarity, it should be noted that the first predetermined pressure and the second predetermined pressure refer to drilling fluid pressures at or above the first end 100 of the piston 22.

In some cases, a mud motor, which optimally operates with drilling fluid having the first predetermined pressure, may be used and higher pressure fluid is not required to move drill cuttings to the surface. In this case, the second predetermined pressure may not be reached, and the flow diverter 10 will remain in the non-diverted position. However, in such a case the flow diverter 10 may act as a pressure relief device to ensure that the drilling fluid pressure does not exceed a predetermined maximum pressure for the mud motor, which is higher than the second predetermined pressure of the flow diverter 10.

Conversely, there may be cases where, once the second predetermined pressure has been reached, the drilling fluid will continue to be pumped at the second predetermined pressure in which case the flow diverter 10 will remain in the full diverted position.

In still another situation, it may be necessary or desirable to vary the drilling fluid pressure. In such a case, the flow diverter 10 automatically adjusts between the non-diverted position and the full diverted position as the fluid pressure changes.

As will be recognized by one skilled in the art, the flow diverter 10 is capable of diverting drilling fluid incrementally between the first predetermined pressure, where the flow diverter 10 is in the non-diverter position, and the second predetermined pressure, where the flow diverter 10 is in the full diverted position. As the drilling fluid pressure increases between the first predetermined pressure and the second predetermined pressure, the piston 22 is forced downward compressing the spring 20. During this downward movement, partial longitudinal alignment of the bypass ports 64, 118, and 134 of the second sub member 14, the piston 22, and the sleeve member 18, respectively, occurs and pressure is progressively diverted through the bypass ports 64, 118, and 134 in proportion to the amount of alignment. Conversely, as the drilling fluid pressure decreases, the spring 20 forces the piston 22 upward and moves the bypass ports 64, 118, and 134 out of alignment and progressively less pressure is diverted in proportion to the amount of alignment.

In the embodiment shown in FIGS. 1-8, direct circumferential alignment of the bypass ports 64, 118, and 134 of the flow diverter 10 is not required for drilling fluid to be diverted. The bypass grooves 66 and 119 of the second sub member 14 and the piston 22, respectively, and the inner bypass groove 136 and the outer bypass groove 138 of the sleeve member 18 allow drilling fluid to pass between the bypass ports 64, 118, and 134 when they are longitudinally aligned but not necessarily circumferentially aligned.

It should be noted, however, that in some embodiments, the flow diverter 10 may be provided with alignment means (not shown) designed to ensure longitudinal alignment of the bypass ports 64, 118, and 134. By way of non-limiting example, the alignment means may be, for instance, an alignment groove and pin between the piston 22 and the sleeve member 18 configured to maintain longitudinal alignment of the bypass ports 64, 118, and 134.

To control the first and second predetermined pressures, the spring rate of the spring 20 as well as diameter D1 and diameter D2 of the piston 22 may be adjusted for specific fluid weights/densities and flow rates to ensure appropriate pressure is supplied to the downhole tool as well as providing sufficient pressure to move drill cuttings to the surface.

To adjust the spring rate of the spring 20, a diameter of or number of coils of the spring 20 may be selected, or, alternately, at least one spacer may be positioned, for instance, between the first end of the spring 20 and the shoulder 114 of the piston 22 thereby preloading the spring 20. A thickness of the spacer or spacers establishes the desired preloading of the spring 20. These spacers can be changed to control the desired amount of diverted fluid for different total fluid flow rates, thereby providing optimal fluid flow through the mud motor for all anticipated flow rates for a given application.

Although the connecting portion 44 of the first sub member 12 has been shown and described herein as formed on the inner surface 34 of the first sub member 12 and the connecting portion 86 of the third sub member 16 has been shown and described as formed on the outer surface 72 of the third sub member 16, it should be understood that the connecting portions 44 and 86 may be configured differently as necessary while remaining within the scope and coverage of the inventive concepts disclosed and herein.

Figure 9:
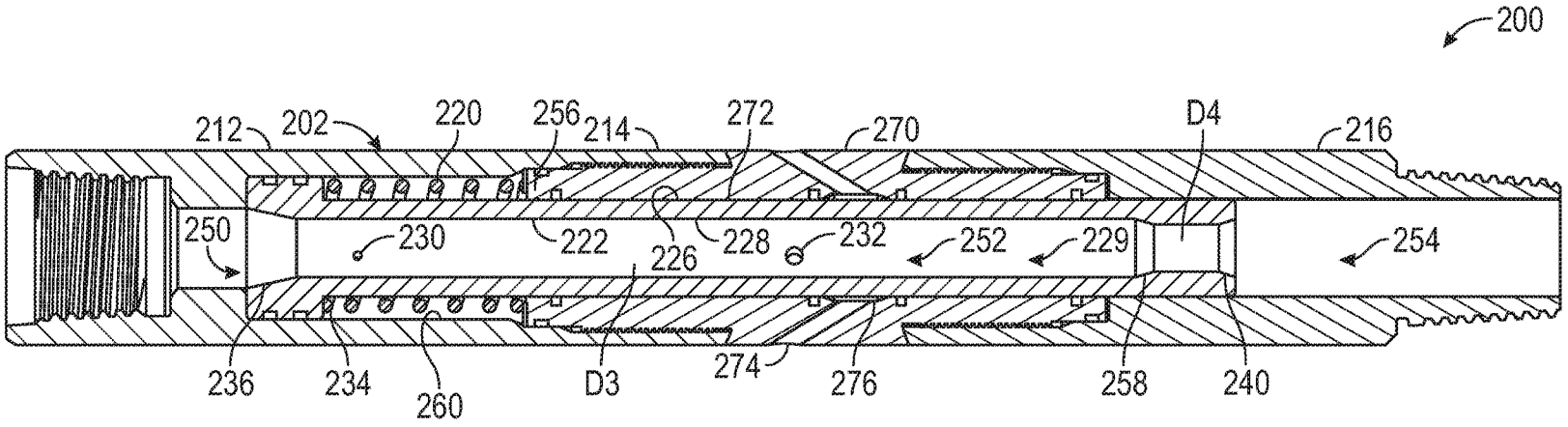
FIG. 9 is a longitudinal section view of one embodiment of a flow diverter shown in a non-diverted configuration in accordance with the presently disclosed inventive concepts.

Referring now to FIG. 9, shown therein is an embodiment of a flow diverter 200 in accordance with the present disclosure. The features of the flow diverter 200 are similar to those found in the flow diverter 10, therefore, in the interest of brevity, only the features of the flow diverter 200 that are different will be described herein. In general, the flow diverter 200 has a housing 202 that may include a first sub member 212, a second sub member 214, and a third sub member 216. The flow diverter 200 further includes at least one spring 220 and a piston 222.

As shown in FIG. 9, the piston 222 may be provided with an outer surface 226, an inner surface 228 defining a central bore 229, a plurality of relief bores 230 (only one of which is designated in FIG. 9), a plurality of bypass bores 232 (only one of which is designated in FIG. 9), a shoulder 234, a first orifice 236, a second orifice 238, and a third orifice 240.

In this embodiment, at least a portion of the piston 222 is slidably disposed for reciprocal longitudinal movement within a first bore 250 of the first sub member 212, a second bore 252 of the second sub member 214, and a third bore 254 of the third sub member 216.

The spring 220 concentrically surrounds at least a portion of the outer surface 226 of the piston 222 and is disposed within a spring receiving chamber 260 defined by the first bore 250 of the first sub member 212 on one side and the outer surface 226 of the piston 222 on the other side, and the shoulder 234 formed on the outer surface 226 of the piston 222 at one end and a first end 256 of the second sub member 214 at the other end.

In this embodiment, the plurality of relief bores 230 are formed in the piston 222 extending from the outer surface 226 to the inner surface 228 of the piston 222. The relief bores 230 are at least partially longitudinally aligned with the spring receiving chamber 260 as the piston 222 reciprocates longitudinally and are configured to allow pressure to be equalized between the spring receiving chamber 260 and the central bore 229 of the piston 222 as the piston 222 is forced downward compressing the spring 220. This pressure equalization reduces the amount of fluid pressure necessary to move the piston 222 downward. A diameter of the relief bores 230 may be sized appropriately to control the amount of fluid pressure necessary to move the piston 222.

In the embodiment shown in FIG. 9, the central bore 229 of the piston 222 is provided with a first diameter D3 extending from the first orifice 236 to the second orifice 238 and a second diameter D4 extending from the second orifice 238 to the third orifice 240.

As shown in FIG. 9, in one embodiment of the flow diverter 200, the second sub member 214 may be provided with an outer surface 270, an inner surface 272, a plurality of bypass ports 274 (only one of which is designated in FIG. 9) extending from the inner surface 272 through the outer surface 270, and a bypass groove 276 extending a predetermined distance into the inner surface 272.

In operation of the flow diverter 200, the spring 220 exerts sufficient force on the piston 222 to bias the piston 222 upward when drilling fluid that is at or below a first predetermined pressure is passed through the flow diverter 200. When the piston 222 is in the upward position, the flow diverter 200 is in a non-diverted position, as shown in FIG. 9.

When drilling fluid having a second predetermined pressure, which is greater than the first predetermined pressure, is passed through the flow diverter 200, the drilling fluid having the second predetermined pressure exerts sufficient force on the piston 222 to compress the spring 220 and force the piston 222 downward until the bypass ports 232 of the piston 222 are substantially aligned with the bypass groove 276 and/or the bypass ports 274 of the second sub member 214. When the bypass ports 232 of the piston 222 are substantially aligned with the bypass groove 276 and/or the bypass ports 274 of the second sub member 214, at least a portion or the drilling fluid is communicated through the bypass ports 232 and 274 and out of the flow diverter 200. When the piston 222 is in the downward position, the flow diverter 200 is in a full diverted position.

As the pressure of the drilling fluid is reduced below the second predetermined pressure, the spring 220 begins to bias the piston 222 upward toward the non-diverted position until the first predetermined pressure is reached and the piston 222 is in the non-diverted position.

As will be appreciated by one of skill in the art, to control the first and second predetermined pressures the flow diverter 200 may be selectively adjusted as described above with reference to the flow diverter 10.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the scope and coverage of the inventive concepts disclosed herein.

What is claimed is:

1. A flow diverter, comprising:

a housing having a first end, a second end, a longitudinal bore extending from the first end to the second end, an outer surface, an inner surface, and a plurality of bypass ports extending from the inner surface to the outer surface;

a piston slidably disposed in the longitudinal bore of the housing, the piston having a first end, a second end, an outer surface, an inner surface forming a piston bore extending from the first end of the piston to the second end of the piston, and a plurality of bypass ports extending from the inner surface of the piston to the outer surface of the piston, the outer surface of the piston cooperating with the housing to define a spring receiving chamber; and a spring positioned in the spring receiving chamber in a way to bias the piston in a first position wherein the bypass ports of the piston are fluidically sealed from the bypass ports of the housing and in a way that the piston is slidable to a second position wherein the bypass ports of the piston are at least partially aligned with the bypass ports of the housing in response to a predetermined pressure differential between a first pressure at the first end of the piston and a second pressure at the second end of the piston wherein the first pressure is greater than the second pressure, the spring being fluidically sealed from the piston bore.

2. The flow diverter of claim 1, wherein the housing has a lower internal shoulder formed to support the piston in the second position.

3. The flow diverter of claim 2, wherein the lower internal shoulder of the housing is formed so that the second end of the piston contacts the lower internal shoulder when the piston is in the second position.

4. The flow diverter of claim 3, wherein the housing has an upper internal shoulder formed to support the piston in the first position.

5. The flow diverter of claim 1, wherein the piston further comprises a bypass groove formed in the outer surface thereof and wherein the plurality of bypass ports extend from the inner surface of the piston through the bypass groove.

6. The flow diverter of claim 1, wherein the spring biases the piston toward the first end of the housing.

7. The flow diverter of claim 1, wherein the bypass ports of the housing angle toward the first end of the housing from the inner surface to the outer surface.

8. A flow diverter, comprising:

a first sub member having a first end, a second end, and a first bore extending from the first end to the second end;

a second sub member having a first end, a second end, a second bore extending from the first end to the second end, an outer surface, and a plurality of bypass ports extending from the second bore to the outer surface, the second end of the first sub member being connected to the first end of the second sub member such that the first bore and the second bore are in fluid communication;

a third sub member having a first end, a second end, and a third bore extending from the first end to the second end, the second end of the second sub member being connected to the first end of the third sub member such that the second bore and the third bore are in fluid communication;

a sleeve member having a first end, a second end, an outer surface, an inner surface defining a sleeve member bore extending from the first end to the second end, and a plurality of bypass ports extending from the inner surface to the outer surface, the sleeve member being positioned within the second bore of the second sub member such that the bypass ports of the sleeve member are substantially aligned with the plurality of bypass ports of the second sub member;

a piston slidably disposed in the first bore, the third bore, and the sleeve member bore, the piston having a first end, a second end, an outer surface, an inner surface forming a piston bore extending from the first end to the second end, and a plurality of bypass ports extending from the inner surface to the outer surface of the piston, the outer surface of the piston cooperating with the first bore of the first sub member to define a spring receiving chamber; and a spring positioned in the spring receiving chamber in a way to bias the piston in a first position wherein the bypass ports of the piston are fluidically sealed from the bypass ports of the sleeve member and in a way that the piston is slidable to a second position wherein the bypass ports of the piston are at least partially aligned with the bypass ports of the sleeve member in response to a predetermined pressure differential between a first pressure at the first end of the piston and a second pressure at the second end of the piston wherein the first pressure is greater than the second pressure, the spring being fluidically sealed from the piston bore.

9. The flow diverter of claim 8, wherein the third sub member has an internal shoulder formed to support the piston in the second position.

10. The flow diverter of claim 9, wherein the lower internal shoulder of the third sub member is formed so that the second end of the piston contacts the lower internal shoulder when the piston is in the second position.

11. The flow diverter of claim 10, wherein the first sub member has an internal shoulder formed to support the piston in the first position.

12. The flow diverter of claim 8, wherein the sleeve member further comprises an inner bypass groove formed on the inner surface thereof and an outer bypass groove formed on the outer surface thereof, the bypass ports of the sleeve member extending from the inner bypass groove to the outer bypass groove.

13. The flow diverter of claim 8, wherein the piston further comprises a bypass groove formed in the outer surface thereof and wherein the plurality of bypass ports extend from the inner surface of the piston through the bypass groove.

14. The flow diverter of claim 8, wherein the spring biases the piston toward the first sub member.

15. The flow diverter of claim 8, wherein the bypass ports of the second sub member angle toward the first sub member from the inner surface to the outer surface.

* * * * *